US006456236B1

(12) United States Patent
Hauck et al.

(10) Patent No.: US 6,456,236 B1
(45) Date of Patent: Sep. 24, 2002

(54) FERROELECTRIC/PARAELECTRIC/ COMPOSITE MATERIAL LOADED PHASED ARRAY NETWORK

(75) Inventors: Bryan L. Hauck, Marion; James B. West, Cedar Rapids, both of IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/841,147

(22) Filed: Apr. 24, 2001

(51) Int. Cl.[7] ..... H01Q 3/24
(52) U.S. Cl. ..... 342/372; 343/778
(58) Field of Search ..... 342/368, 372, 342/373; 343/778, 754, 785

(56) References Cited

U.S. PATENT DOCUMENTS 4,305,052 A * 12/1981 Baril et al. ..... 333/164
5,309,166 A * 5/1994 Collier et al. ..... 343/778
5,334,958 A * 8/1994 Babbitt et al. ..... 333/156
5,617,103 A * 4/1997 Koscica et al. ..... 343/700 MS
6,067,047 A * 5/2000 Cook et al. ..... 342/372
6,333,683 B1 * 12/2001 Hampel ..... 333/161

* cited by examiner

*Primary Examiner*—Dao Phan
(74) *Attorney, Agent, or Firm*—Nathan O. Jensen; Kyle Eppele

(57) ABSTRACT

The present invention is directed generally to phased array antennas. The invention allows for the realization of a low-cost, ferroelectric material loaded feed manifold for phase shifting an antenna. This type of architecture can take many forms, with the preferred embodiment being waveguide. In an embodiment of the present invention, the Ferroelectric/Paralectric/Composite material loaded feed manifold described herein may solve the space/weight problem by integrating the material into the traditional waveguide feed manifold. A feed structure suitable for receiving and routing electromagnetic energy may include a subassembly including material suitable for shifting phase of electromagnetic radiation when an electrical field is applied. Material having a dielectric constant at least one of equal to and greater than the phase shifting material may also be included.

16 Claims, 4 Drawing Sheets

FERROELECTRIC/PARAELECTRIC/ COMPOSITE MATERIAL LOADED PHASED ARRAY NETWORK

BACKGROUND OF THE INVENTION

The present invention generally relates to the field of radio and radar applications, and particularly to phased array antennas, such as a ferroelectric/paraelectric/composite material loaded phased array network.

Phased array antennas are required for many radio and radar applications. In the past, cost has been a major impediment to the use of electronically steered phased array antennas. Recent developments in the field of ferroelectric-based phased array antennas have opened new possibilities within the phased array community. Systems that were once cost prohibitive may now be utilized to add/enhance the performance of radio and radar systems.

The use of ferroelectric materials has been of great benefit to phased array antennas. Ferroelectric materials exhibit dielectric properties in which the materials change under the influence of a static electric field. For example, an electrooptic effect may be produced by the application of a bias electric field to ferroelectric materials. Electrooptical variation of the refractive indices of this material causes a phase shift in electromagnetic radiation. For instance, a bias electric field of sufficient magnitude in an appropriate direction may change the refractive index of a medium, and thereby further alter the propagation conditions.

With this new development, new challenges have surfaced. For example, the addition of ferroelectric bulk phase shifters to a planar waveguide phased array antenna can cause space and weight problems. While the bulk phase shifters are capable of performing the job, they add weight, size, and complexity to the antenna.

Therefore, it would be desirable to provide an improved scheme and apparatus for a phased array antenna.

SUMMARY OF THE INVENTION

Accordingly, the present invention is directed to phased array antennas. The invention allows for the realization of a low-cost, ferroelectric material loaded feed manifold for phase shifting an antenna. This type of architecture can take many forms, with the preferred embodiment being waveguide. This feed manifold can replace the traditional air-filled manifolds currently used on flat-plate antennas. In an embodiment of the present invention, the Ferrolectic/Paraelectric/Composite material loaded feed manifold described herein may solve the space/weight problem by integrating the material into the traditional waveguide feed manifold.

In a first aspect of the present invention, a phase shifting apparatus includes a first guide section and a second guide section. The second guide section is suitable for transmission of electromagnetic radiation and includes material suitable for shifting phase when an electrical field is applied. A first electrode is disposed between the first guide section and the second guide section. A second electrode is positioned opposing the first electrode, in which the second guide section is disposed between the first electrode and the second electrode. The first guide section has an impedance which is at least one of equal to and greater than the second guide section.

In a second aspect of the present invention, a phased array antenna includes a feed structure suitable for receiving and routing electromagnetic energy. The feed structure includes a first guide section and a second guide section including material suitable for shifting phase when an electrical field is applied. A first electrode is disposed between the first guide section and the second guide section. A second electrode is positioned opposing the first electrode, wherein the second guide section is disposed between the first electrode and the second electrode. The first guide section has a dielectric constant at least one of equal to and greater than the second guide section In a third aspect of the present invention, a phased array antenna includes a feed structure suitable for receiving and routing electromagnetic energy. The feed structure includes a subassembly including material suitable for shifting phase of electromagnetic radiation when an electrical field is applied. A material suitable for blocking a propagating wave from bypassing the subassembly is also included.

In a fourth aspect of the present invention, a feed structure suitable for receiving and routing electromagnetic energy includes a subassembly including material suitable for shifting phase of electromagnetic radiation when an electrical field is applied. Material having a dielectric constant at least one of equal to and greater than the phase shifting material is also included.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring generally now to FIGS. 1 through 7, exemplary embodiments of the present invention are shown. The invention allows for the realization of a low-cost, ferroelectric material loaded feed manifold for phase shifting an antenna. This type of architecture can take many forms, with the preferred embodiment being a waveguide. The feed manifold may replace the traditional air-filled manifolds currently used on flat-plate antennas. The proposed ferroelectric material loaded waveguide feed manifold circumvents the requirement of bulk phase shifters to perform the phase shifting function.

Figure 1:
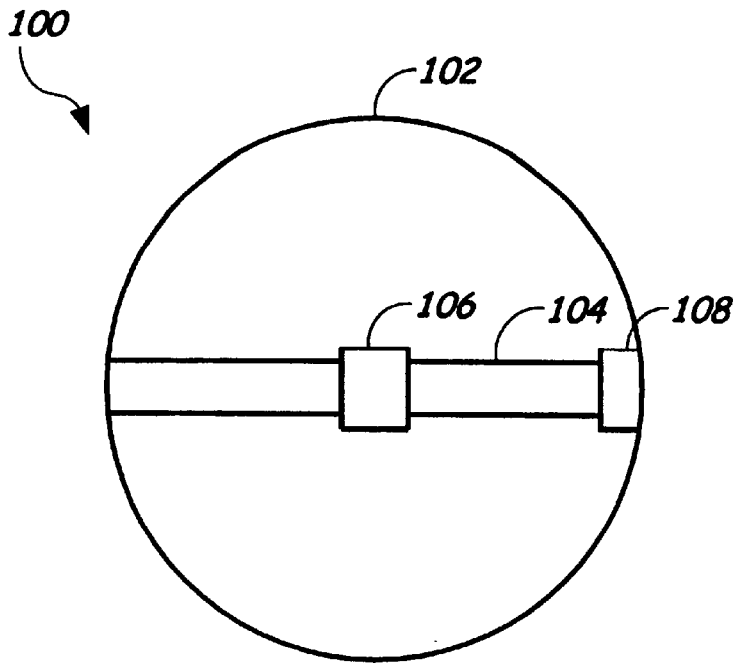
FIG. 1 is an illustration of an embodiment of the present invention wherein a graphical depiction of flat-plate phased array antenna utilizing a feed manifold architecture is shown.

Referring now to FIG. 1, an embodiment 100 of the present invention is shown wherein a graphical depiction of flat-plate phased array antenna utilizing a feed manifold architecture is shown. The proposed embodiment of the invention allows for the replacement of the bulk phase shifters with a single, continuous piece of waveguide, thereby reducing the weight and the added size. A planar waveguide phased array antenna 102 includes a feed manifold 104 disposed therein. Inputs, which may be center 106 or end 108 fed, are coupled to the feed manifold 104.

A property of the ferroelectric material that makes it unique is a variable dielectric constant. The relative dielectric constant of the ferroelectric material may be adjusted by the application of an external DC bias field. The amount of change in the dielectric constant compared to the nominal (0 V external DC field) dielectric constant is related to the strength of the applied external field. However, a major drawback to the use of ferroelectric materials is the high loss associated with these materials.

The equation governing the wave propagation through a waveguide is given by (1), where $\lambda_o$, is the free space wavelength, a is the width of the guide, $\in_r$ is the relative dielectric constant, and d is the length of the waveguide. For standard X-band waveguide, (1) can be approximated by (2), which is the more familiar free space propagation factor. To obtain the equation governing the propagation through an air-filled guide, replace $\in_r$ with 1 in (2). The phase difference between a wave propagating through an air-filled guide of length d and a ferroelectric slab of length d is given in (3). Equation (3) shows that the amount of phase shift gained by propagating through a slab of ferroelectric material is a function of two parameters, the thickness (d) of the slab and the relative dielectric constant ($\in_r$)

$$e^{-j\frac{2\pi}{\lambda_o}d\sqrt{\epsilon_r}}\sqrt{1-\frac{\lambda_o^2}{4a^2\epsilon_r}} \tag{1}$$

$$e^{-j\frac{2\pi}{\lambda_o}d\sqrt{\epsilon_r}} \tag{2}$$

$$\Delta\phi = \frac{2\pi}{\lambda_o}d\left(\sqrt{\epsilon_r}-1\right) \tag{3}$$

As stated earlier, a major drawback to the use of ferroelectric material is the inherent loss. An optimistic estimate of losses based on today's technology is a tan δ of 0.005, which is up to ten times greater than conventional low loss dielectrics. A possible solution is to use a thin (d is small) slab of ferroelectric material and achieve the phase shift through the changing dielectric constant. However, to achieve the necessary change in dielectric constant may require large DC bias fields (in the kV to tens of kV range), which may not be practical in many applications. Since the bias field required is dependent on the height of the sample (V/cm), one technique which may be utilized is to split the ferroelectric slab in half and insert an electrode between the two halves.

Figure 2:
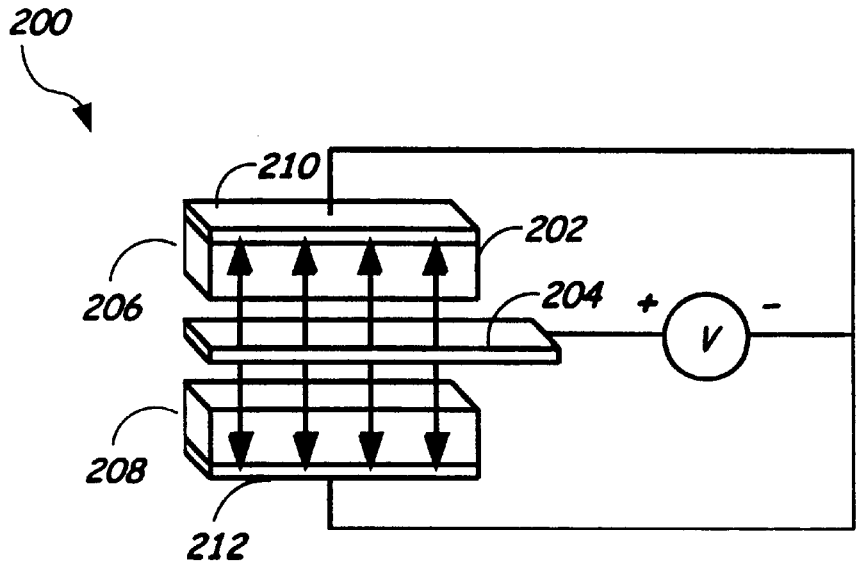
FIG. 2 is a depiction of an embodiment of the present invention wherein a scheme for biasing ferroelectric material in a waveguide is shown.

For example, as shown in FIG. 2, an embodiment 200 of the present invention is shown wherein a scheme for biasing ferroelectric material in a waveguide is shown. A scheme 202 of the present invention may include a center electrode 204 disposed between a first ferroelectric piece 206 and a second ferroelectric piece 208. Electrodes 210 & 212 are disposed opposite the center electrode 204 with the first ferroelectric section 206 and the second ferroelectric section 208 disposed between. In this embodiment, the electrical field is biased away from the center electrode 204 and toward the outer electrodes 210 and 212. This technique lends itself naturally to waveguide mounting. The outer electrodes 210 & 212 may also be utilized as guide walls. By grounding the walls, technicians are protected from the potentially high voltages that may be encountered.

Figure 3:
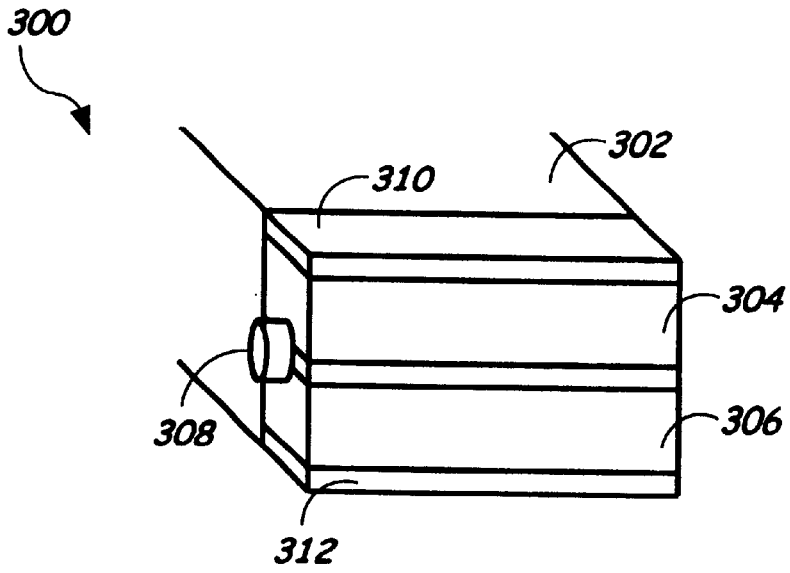
FIG. 3 is an illustration of an embodiment of the present invention in which a piece of ferroelectric material is mounted in a section of waveguide.

Referring now to FIG. 3, an embodiment 300 of the present invention is shown wherein a piece of ferroelectric material is mounted in a section of waveguide. A waveguide 302 includes a first ferroelectric section 304 and a second ferroelectric section 306. A DC connector 308 is coupled to an internal electrode, such as the center electrode 204 (FIG. 2), to create an electrical field between the internal electrode and external electrodes 310 & 312. The electrical field is suitable for biasing the ferroelectric material, and thereby the dielectric constant. In the scenario depicted in FIG. 3, the area occupied by the ferroelectric material is divided into two waveguide sections, a first guide section and a second guide section, by the insertion of the center electrode. Assuming that the two pieces of ferroelectric material are identical, on average half of the incident fields would traverse through the upper guide and half through the lower guide. Further discussion regarding the insertion of a metal bias strip may be found in U.S. Pat. No. 5,309,166, which is herein incorporated by reference in its entirety.

In a field simulation for the ferroelectric loaded waveguide depicted in FIG. 3, the ferroelectric material was assumed to have a loss tangent of 0.005 and a relative dielectric constant of 180. Please note that no matching sections were employed to match the ferroelectric material to the waveguide. Close examination of the first ferroelectric section 306 and the second ferroelectric section 306 created by the ferroelectric material indicates that an equal amount of energy passed through both sections.

However, the use of the ferroelectric material may cause losses. By reducing, the amount of ferroelectric material through which the wave propagates, the amount of loss may be reduced. One way of accomplishing this is to remove the upper half of the ferroelectric material. This creates two waveguides, wherein the first guide is a section of half-height air-filled waveguide, and the second guide is a section of half-height ferroelectric-filled waveguide.

A field simulation was performed in which the results of removing the first section of ferroelectric material for a half-ferroelectric, half air loaded waveguide were determined. Since the nature of RF propagation is to seek the path which offers the least resistance, the majority of the field propagated through the air-filled guide with very little field propagating through the ferroelectric material. Since the fields circumvent the ferroelectric-filled guide, the effects of the ferroelectric material in the system were neutralized.

Therefore, to force the fields to propagate through the ferroelectric material, in an embodiment of the present invention, the first guide presents more resistance to the propagation than the second guide. To accomplish this, the first guide may be filled with a low loss, low cost ceramic material which posses a dielectric constant equal to or greater than the ferroelectric material of the second guide. The biasing scheme and a graphical representation of a section of waveguide are shown in FIGS. 4 and 5, respectively.

Figure 4:
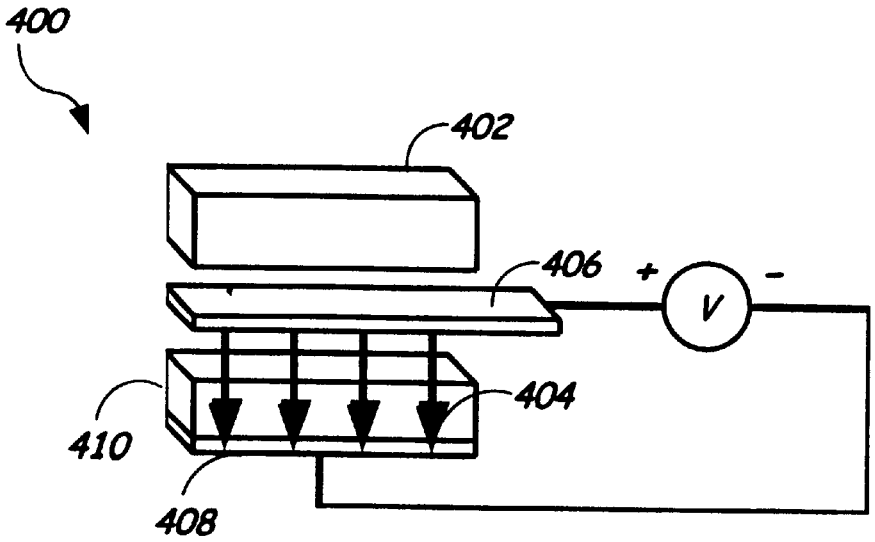
FIG. 4 is an illustration of an embodiment of the present invention wherein a scheme for biasing hybrid material combination in a waveguide includes a first guide section having greater impedance than a second ferroelectric guide section.

Referring now to FIG. 4, an embodiment 400 of the present invention is shown wherein a scheme for biasing hybrid material combination in a waveguide includes a first guide section having greater resistance than a second ferroelectric guide section. A first guide section 402 and a second ferroelectric guide section 404 are disposed on opposing sides of a first electrode 406. A side of the waveguide may form an RF ground for the first guide section 402. A second electrode 408 is oriented on opposing side of the second ferroelectric guide section 404 than the first electrode 406. In this example, an electrical field formed between the first electrode 406 and the second electrode 408 is biased from the first electrode 406. The first guide section 402 has a resistance at least equal to or greater than the second ferroelectric guide section 404. There are a variety of materials which may be utilized to provide resistance for the first guide section as contemplated by a person of ordinary skill in the art without departing from the spirit and scope of the present invention, such as a ceramic material and the like.

Figure 5:
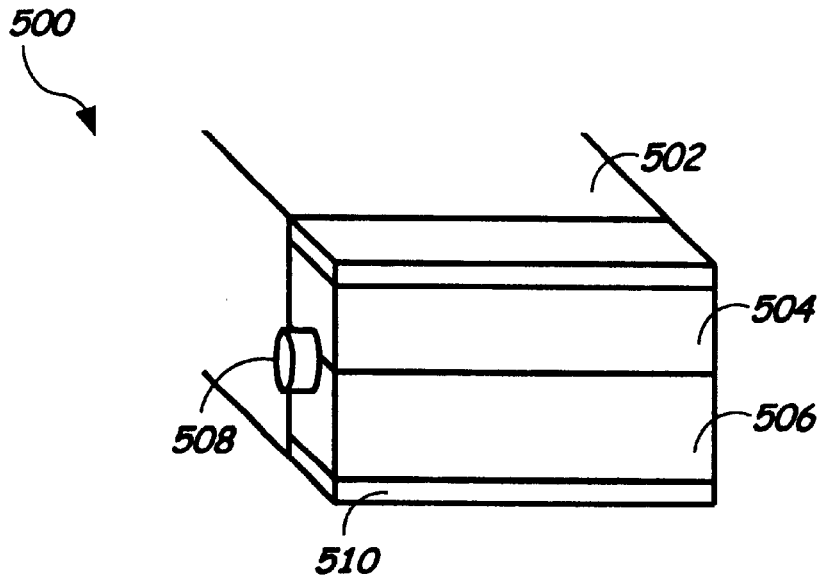
FIG. 5 is a depiction showing an exemplary embodiment of the present invention wherein a waveguide may include a first guide section formed of ceramic and a second guide section formed of ferroelectric material.

For example, as shown in FIG. 5, a waveguide may include a first guide section formed of ceramic and a second guide section formed of ferroelectric material. A waveguide 502 includes a first ceramic section 504 and a second ferroelectric section 506. A DC connector 508 is coupled to an internal electrode, such as the first electrode 406 (FIG. 4), to create an electrical field between the first electrode 406 (FIG. 4) and an external electrode 510. With this hybrid approach, the amount of ferroelectric material required has been reduced by half while maintaining the same phase shifting capability. The addition of the low loss, high dielectric ceramic forces the majority of the propagating fields to travel through the ferroelectric material. A simulation of the above approach was performed. The ceramic material used has a loss tangent of 0.0001 and a dielectric constant of 360. Examination of the simulation indicated that the majority of the fields propagated through the ferroelectric material.

Additionally, if the height of the ferroelectric were reduced to less than half of the guide height, the Electric field strength in the ferroelectric material would be increased. This would allow for a larger adjustment of $\in_r$ for a given DC bias constraint. Since the phase shift through the material depends on both the dielectric constant and the thickness, by increasing the dielectric constant, one can use thinner samples. The use of thinner samples is attractive because the more material a wave propagates through, the higher the losses. Reducing the thickness of the ferroelectric material will reduce the overall loss. As before, the remaining section of the guide may be filled with a low loss ceramic, as shown in FIG. 6.

Figure 6:
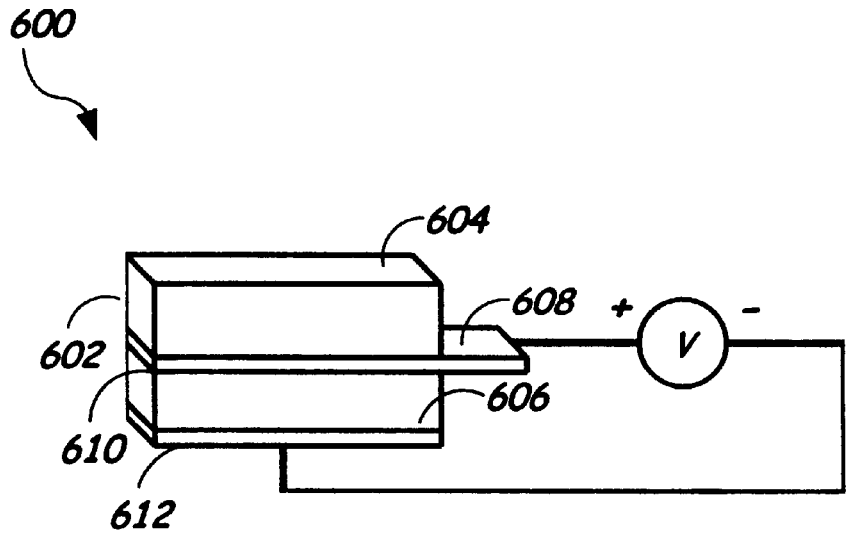
FIG. 6 is a depiction of an exemplary embodiment of the present invention wherein a biasing scheme is implemented in which an unequal ferroelectric to ceramic material ratio is utilized to reduce overall loss by requiring thinner pieces of ferroelectric material.

Referring now to FIG. 6, an embodiment 600 of the present invention is shown wherein a biasing scheme is implemented in which an unequal ferroelectric to ceramic material ratio is utilized to reduce overall loss by requiring thinner pieces of ferroelectric material. A waveguide 602 includes a first ceramic section 604 and a second ferroelectric section 606. A DC connector 608 is coupled to an internal electrode 610 to create an electrical field between the internal electrode 610 and an external electrode 612. In this instance, the second ferroelectric section 606 is smaller than the first ceramic section 604. A top waveguide section may form an RF ground for the first ceramic section 604. It should be apparent that a person of ordinary skill in the art may change the ratio of sizes between the ferroelectric section and the ceramic section as desired without departing from the spirit and scope of the present invention. For example, in implementation wherein lowering overall loss was desired, a smaller section of ferroelectric material may be utilized.

Figure 7:
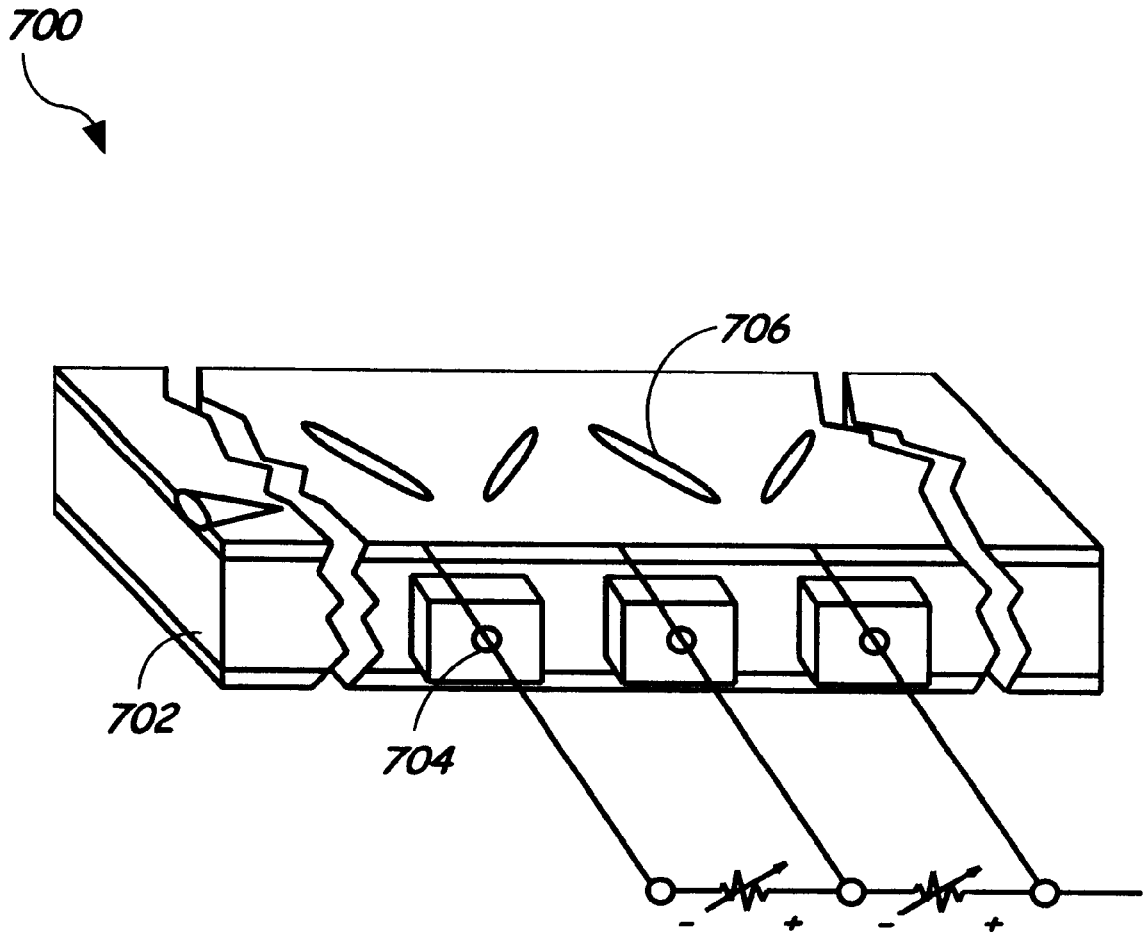
FIG. 7 is an illustration of an embodiment of the present invention wherein an inhomogeneous, periodically loaded feed manifold is shown.

Although the previous discussion has addressed a single ferroelectric/ceramic combination in a waveguide for discussion purposes, it should be apparent that a variety of implementations are contemplated by the present invention. For example, an extension of this idea may be to periodically load a waveguide with sections of the ferroelectric/ceramic hybrid, as shown in the embodiment 700 depicted in FIG. 7. A feed manifold 702 includes a ferroelectric subassembly 704 for shifting the phase of RF energy passing therethrough. Coupling slots 706 are also included, the coupling slots 706 suitable for attaching to a radiation linear array (not shown). The proposed feed manifold shown in FIG. 7 is inhomogeneous in the sense that the ferroelectric material occupies only a fraction of the guide height. The ceramic material may be introduced to block a propagating wave from bypassing the ferroelectric subassembly 704. This type of feed manifold configuration lends its self to easy integration into existing waveguide antennas. Further, dielectric matching sections may be mounted in an air section of a guide to reduce reflections, as contemplated by a person of ordinary skill in the art without departing from the spirit and scope of the present invention.

Although the discussion here has been limited to ferroelectric material, the principles and techniques would also apply to paraelectric materials and other composite materials that exhibit properties similar to that of the ferroelectric material. The techniques and principles described herein can be naturally extended to other types of feed structures, such as co-axial, microstrip, and stripline configurations, and are not limited to the waveguide embodiments described. In the cases described, the ferroelectric material was segmented in the horizontal direction for discussion purposes. This does not have to be the case, as the ferroelectric material may be segmented in a variety of ways, depending upon the specific application as contemplated by a person of ordinary skill in the art.

It is believed that the phased array of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A phase shifting apparatus, comprising:

a first guide section;

a second guide section suitable for transmission of electromagnetic radiation, the second guide section including material suitable for shifting phase when an electrical field is applied;

a first electrode disposed between the first guide section and the second guide section; and a second electrode positioned opposing the first electrode, wherein the second guide section is disposed between the first electrode and the second electrode;

wherein the first guide section has an impedance which is at least one of equal to and greater than the second guide section.

2. The phase shifting apparatus as described in claim 1, wherein the material suitable for shifting phase when an electrical field is applied includes at least one of ferroelectric material and paraelectric material.

3. The phase shifting apparatus as described in claim 1, wherein the first electrode and the second electrode form an electrical field between the first electrode and the second electrode, the electrical field suitable for biasing the material suitable for shifting phase included in the second guide section.

4. The phase shifting apparatus as described in claim 1, wherein the first guide section is at least one of ceramic and dielectric material.

5. The phase shifting apparatus as described in claim 1, wherein an unequal ratio of the first guide section to the second guide section is utilized.

6. The phase shifting apparatus as described in claim 1, wherein the second guide section is smaller than the first guide section.

7. The phase shifting apparatus as described in claim 1, wherein the phase shifting apparatus is suitable for being utilization in a feed structure including at least one of a waveguide, co-axial, microstrip and stripline.

8. A phased array antenna, comprising:

a feed structure suitable for receiving and routing electromagnetic energy, the feed structure including a subassembly including material suitable for shifting phase of electromagnetic radiation when an electrical field is applied; and material suitable for blocking a propagating wave from bypassing the subassembly.

9. The phased array antenna as described in claim 8, wherein the blocking material has an impedance which is at least one of equal to and greater than the phase shifting material.

10. The phased array antenna as described in claim 8, wherein the material suitable for shifting phase when an electrical field is applied includes at least one of ferroelectric material and paraelectric material.

11. The phased array antenna apparatus as described in claim 8, further comprising a first electrode and a second electrode to form an electrical field between the first electrode and the second electrode, the electrical field suitable for biasing the phase shifting material.

12. The phased array antenna as described in claim 8, wherein feed structure includes at least one of a waveguide, co-axial, microstrip and stripline.

13. A feed structure suitable for receiving and routing electromagnetic energy, comprising:

a subassembly including material suitable for shifting phase of electromagnetic radiation when an electrical field is applied; and material having a dielectric constant at least one of equal to and greater than the phase shifting material.

14. The feed structure as described in claim 13, wherein the material suitable for shifting phase when an electrical field is applied includes at least one of ferroelectric material and paraelectric material.

15. The feed structure as described in claim 13, further comprising a first electrode and a second electrode to form an electrical field between the first electrode and the second electrode, the electrical field suitable for biasing the phase shifting material.

16. The feed structure as described in claim 13, wherein me feed structure includes at east one of a waveguide, co-axial, microstrip and stripline.

* * * * *